US008147175B2

(12) United States Patent
Brewer, III et al.

(10) Patent No.: US 8,147,175 B2
(45) **Date of Patent: *Apr. 3, 2012**

(54) STACKER CART

(75) Inventors: Charles R Brewer, III, Farmington, NY (US); Thomas C Palumbo, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 369 days.

This patent is subject to a terminal disclaimer.

(21) Appl. No.: 12/209,539

(22) Filed: Sep. 12, 2008

(65) Prior Publication Data

US 2010/0068019 A1 Mar. 18, 2010

(51) Int. Cl.
*B65G 67/00* (2006.01)

(52) U.S. Cl. ..... 414/349; 414/608; 280/33.997; 280/47.35

(58) Field of Classification Search ..... 414/349, 414/608; 280/33.997, 33.998, 47.35
See application file for complete search history.

(56) References Cited

U.S. PATENT DOCUMENTS

| | | | | | |
|---|---|---|---|---|---|
| 3,720,329 | A * | 3/1973 | Gamble | 414/531 |
| 4,266,791 | A * | 5/1981 | Myers | 280/37 |
| 4,283,164 | A * | 8/1981 | Reaney | 414/396 |
| 4,288,195 | A * | 9/1981 | Brewer | 414/608 |
| 4,610,445 | A * | 9/1986 | Schneider et al. | 271/160 |
| 4,668,148 | A * | 5/1987 | Sample et al. | 414/790.8 |
| 5,152,655 | A * | 10/1992 | Pipes | 414/344 |
| 5,186,479 | A * | 2/1993 | Flowers | 280/47.35 |
| 5,404,817 | A * | 4/1995 | Cuff | 101/232 |
| 5,452,983 | A * | 9/1995 | Parmley, Sr. | 414/345 |
| 5,503,517 | A * | 4/1996 | Derby | 414/814 |
| 6,179,499 | B1 * | 1/2001 | Beretta et al. | 400/605 |
| 6,206,424 | B1 * | 3/2001 | Edwards et al. | 280/845 |
| 7,798,501 | B1 * | 9/2010 | Hopkins | 280/47.35 |

* cited by examiner

*Primary Examiner* — Scott Lowe
(74) *Attorney, Agent, or Firm* — Ellis B. Ramirez; Prass LLP

(57) ABSTRACT

This is a stacker cart useful to collect a paper stack in a paper-handling system. The stacker cart has wheels so that it can be moved into and out of a housing in the system. At a top section of the stacker cart is a slidable plate that receives the paper stack after processing, finishing or marking. This slidable plate has on its lower surface sliders that allow easy moving of the slidable plate off the stacker cart. The slidable plate has at least one hook that is connected to a rope or other remover for moving the slidable plate to a second surface.

15 Claims, 9 Drawing Sheets

STACKER CART

This invention relates to electrophotographic marking systems and, more specifically, to paper stacker carts used in such systems.

CROSS REFERENCE

Illustrated and disclosed in a co-pending application (U.S. application Ser. No. 12/209,287, filed Sep. 12, 2008) owned by the present assignee is an application relating to a tilting pivot plate useful in lifting a paper stack from a marking machine. The application based upon U.S. application Ser. No. 12/209,287, filed Sep. 12, 2008 is filed in the U.S. Pat. and Trademark Office on the same date as the present application based upon U.S. application Ser. No. 12/209,287, filed Sep. 12, 2008. The disclosure of U.S. application Ser. No. 12/209,287, filed Sep. 12, 2008 is totally incorporated herein by reference.

BACKGROUND

While the present invention can be effectively used in a plurality of paper-handling or marking systems, it will be described for clarity as used in finisher modules of electrostatic marking systems such as electrophotography. In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development, the toner particles are attracted from the carrier particles by the charge pattern of the image areas on the photoconductive insulating area to form a powder image on the photoconductive insulating area to form a powder image on the photoconductive area. This image may be subsequently transferred or marked onto a support surface such as copy paper to which it may be permanently affixed by heating or by the application of pressure. Following transfer of the toner image or marking, the copy paper may be removed from the system by a user or may be automatically forwarded to a finishing station where the copies may be collected, compiled and stapled and formed into books, pamphlets or other sets. This invention will be described throughout in reference to paper collected after the finishing station processes are completed. It should be understood, however, that the present invention can be used in any systems where paper is collected in paper stacks.

As above noted, there are many marking systems that transport paper or other media after the paper is marked in marking step or steps. These marking systems could include electrostatic marking systems, non-electrostatic marking systems and printers or any other system where paper or other flexible media or receiving sheets are transported internally to an output device such as a finisher and compiler station or stations and the subsequent stacking of paper after the compiler completes its functions.

These electrostatic marking systems have finisher and compilers located at a site after the receiving sheets (paper) have been marked with a toner. After finishing is completed, the paper is conveyed to a paper-stacking device generally conveniently located at a bottom portion of the finisher module of a marking machine. A stacking cart generally used is movable so that it can be moved into and out of the finisher module when loaded with paper. Current paper stacking involves the use of carts on casters for compiling paper stacks in printers. Once the carts are loaded, a manual process of unloading small stacks at a time from the main stack is needed. The entire stack cannot be unloaded or staged at once.

SUMMARY

The present invention is to provide a very low profile paper-sliding plate to allow stacks of paper to accumulate on the resident stack cart. Once the stack cart is filled to capacity, the stack-sliding plate, using the low profile UHMW (ultra high molecular weight) bearing surfaces, can be simply off loaded from the cart onto a portable lift device. With the unique characteristics of the bearings, low profile, non-directional functionality and resistance to contamination, a long lasting, large capacity, easily moved plate that can transport and unload off of a paper cart or pull out paper drawer can be used.

Current paper stacking involves the use of carts on casters for compiling paper stacks in high volume printers. This invention proposes a very low profile, intermediate paper-stacking plate to allow stacks of paper to accumulate on a resident stack cart. Once the stack cart is filled to capacity (or job completion), the stack plate, using low profile UHMW (ultra high molecular weight) bearing surfaces similar to furniture moving glides, can be simply "off loaded" from the cart onto a second support or device such as a portable lift device. With the unique characteristics of these sliding bearings (low profile, non-directional, contaminate resistant), it creates a long lasting, large potential capacity, easily moved plate that can transport and unload from a paper cart or pullout paper drawer. This invention provides an improvement to the prior stacker cart systems.

The stacking cart of this invention has wheels (or other movables) for easy installing and removal from the marking machine. It has two or more openings into which an upright handle can be inserted when moving this stacking cart. On the upper paper-receiving surface portion of the stacker cart is a detachable sliding plate that supports the paper stack and is easily off loaded onto another structure. This sliding plate has on its bottom surface a plurality of sliders or bearings similar to those used on the bottom of furniture such as Magic Sliders (a trademark of Magic Sliders, L.P.), 50 Main St., While Plains, N.Y. 10606. Various size and shape slides can be used varying from 10 mm to about 100 mm. The sliding plate, depending on its size, can have from 3 to 12 slides or bearings attached to its bottom face. Located around the sides of the sliding plate are cutout or slot portions which accommodate and define various size of paper that may be stacked on its upper surface. Clamps inserted into these slots will hold the paper stacks in place. There can be any suitable number of slots in the sliding plate but at least 2 slots. The sliding plate fits into stacker carts so that no re-engineering of present structures is required for use in present marking machines. Once the desired stack of paper is on the sliding plate (supported by the movable stacking cart), the stacking cart is pulled out of the marking machine and the paper moved via the sliding plate off the stacking cart. For example, it can be transferred to the lifting mechanism and tilting plate of co-pending U.S. application Ser. No. 12/209,287, filed Sep. 12, 2008.

The stacker cart of this invention has on its upper receiving surface the sliding plate which will receive the papers and paper stack after they are processed. The sliding plate, as above noted, has sliders on its lower surface, has slots on its sides that define various paper sizes and at least one hook on one of its four sides. The slots are used together with clamps to hold the paper stack in position on the sliding plate. The sliding plate may be made from plastic, metal, wood, a combination of these or any other suitable material. The sliders on the bottom surface of the sliding plate may be made from any smooth, hard and slidable material such as that in the earlier-mentioned "Magic Sliders" obtainable from Magic Sliders, L.P. of White Plains, N.Y. 10606.

DETAILED DISCUSSION OF DRAWINGS AND PREFERRED EMBODIMENTS

Figure 1:
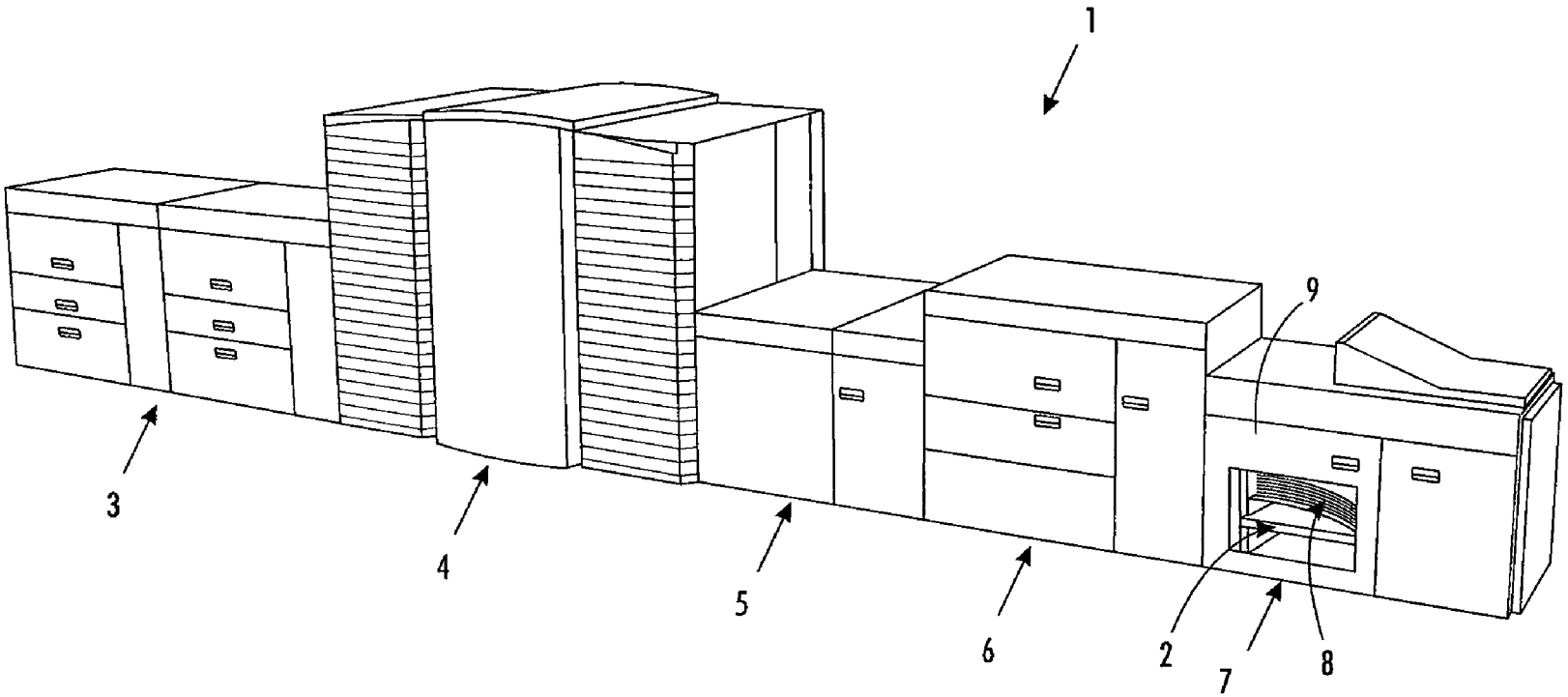
FIG. 1 illustrates a typical marking and compiler apparatus in which the finisher stacker cart of this invention can be used.

In FIG. 1, a typical marking-finisher system 1 is shown where the stacker cart 2 of this invention can be used together with any other system where paper is stacked and subsequently removed. This marking-finisher system 1 comprises a paper feeder module 3, a printing module 4, an inverter module 5, an inserter module 6 and a finisher module 7. The finisher module 7 contains the stacker cart 2 of this invention. The finished paper stack 8 supported on the stacker cart 2 of this invention can be seen through door 9. Once door 9 is opened, the stacker cart 2 of this invention can be removed.

Figure 2:
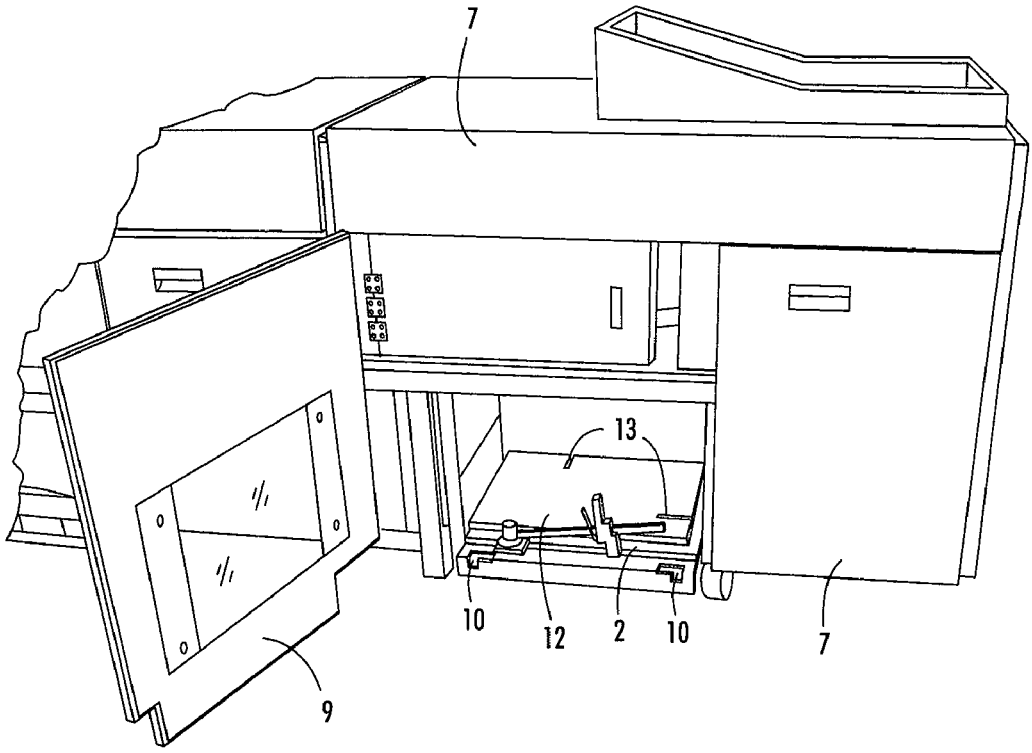
FIG. 2 illustrates an embodiment of this invention where the stacker cart has as its upper portion a sliding plate when installed in the marking-finisher machine or module but without a paper stack.
Figure 3:
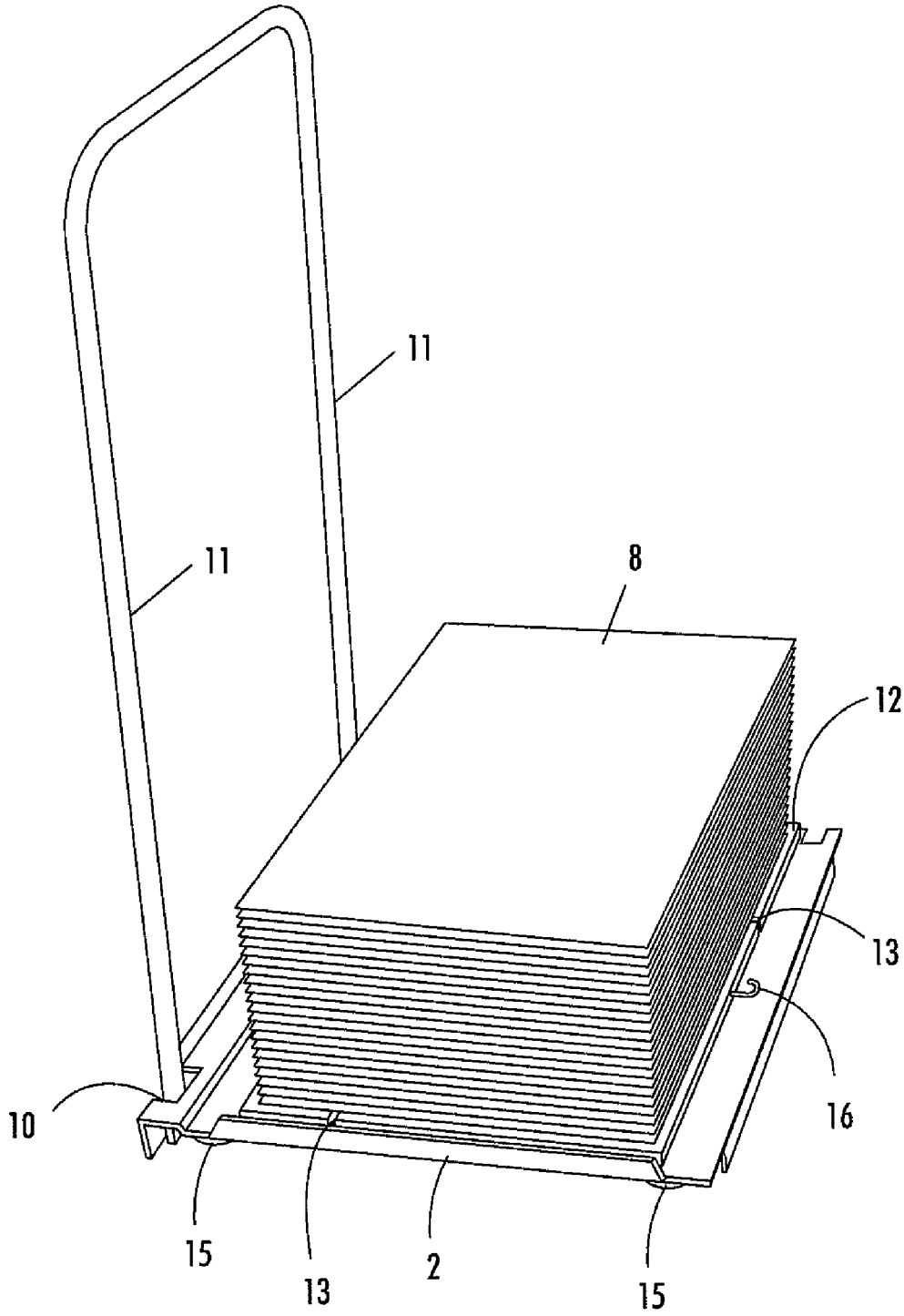
FIG. 3 illustrates an embodiment where the stacker cart with its upper surface containing the sliding plate as it is removed from the marking machine with a paper stack in place.

In FIG. 2, the stacker cart 2 of this invention is shown installed in finisher module 7 before the accumulation of a paper stack 8. When door 9 is opened, as shown in this Figure, the stacker cart 2 which is on wheels (not shown) can be removed from the finisher module 7. There are apertures 10 in the front of stacker cart 2 into which a remover handle 11, shown in FIG. 3, is inserted to pull the stacker cart 2 from the finisher module 7. The upper surface of the stacker cart 2 comprises a sliding plate 12 having slots 13 to accommodate various size paper and clamps. Clamps 14 (shown in FIG. 5) hold the paper stack 8 in place.

In FIG. 3, the stacker cart 2 of this invention is removed from finisher module 7. The wheels 15 and handle 11 permit easy removal of stacker cart 2 from the finisher module 7. The paper stack 8 is held in place by clamps 14 shown in FIG. 5. The sliding plate can be pulled off the stacker cart 2 and placed on any receiving surface convenient to the user. The paper stack 8 with the sliding plate 12 is easily pulled off the stacker cart 2 by the use of at least one hook remover 16 (or any other suitable removal means). Once sliding plate 12 and paper stack 8 are removed, the empty stacking cart 2 with another sliding plate 12 can be reinserted into the finishing module 7.

Figure 4:
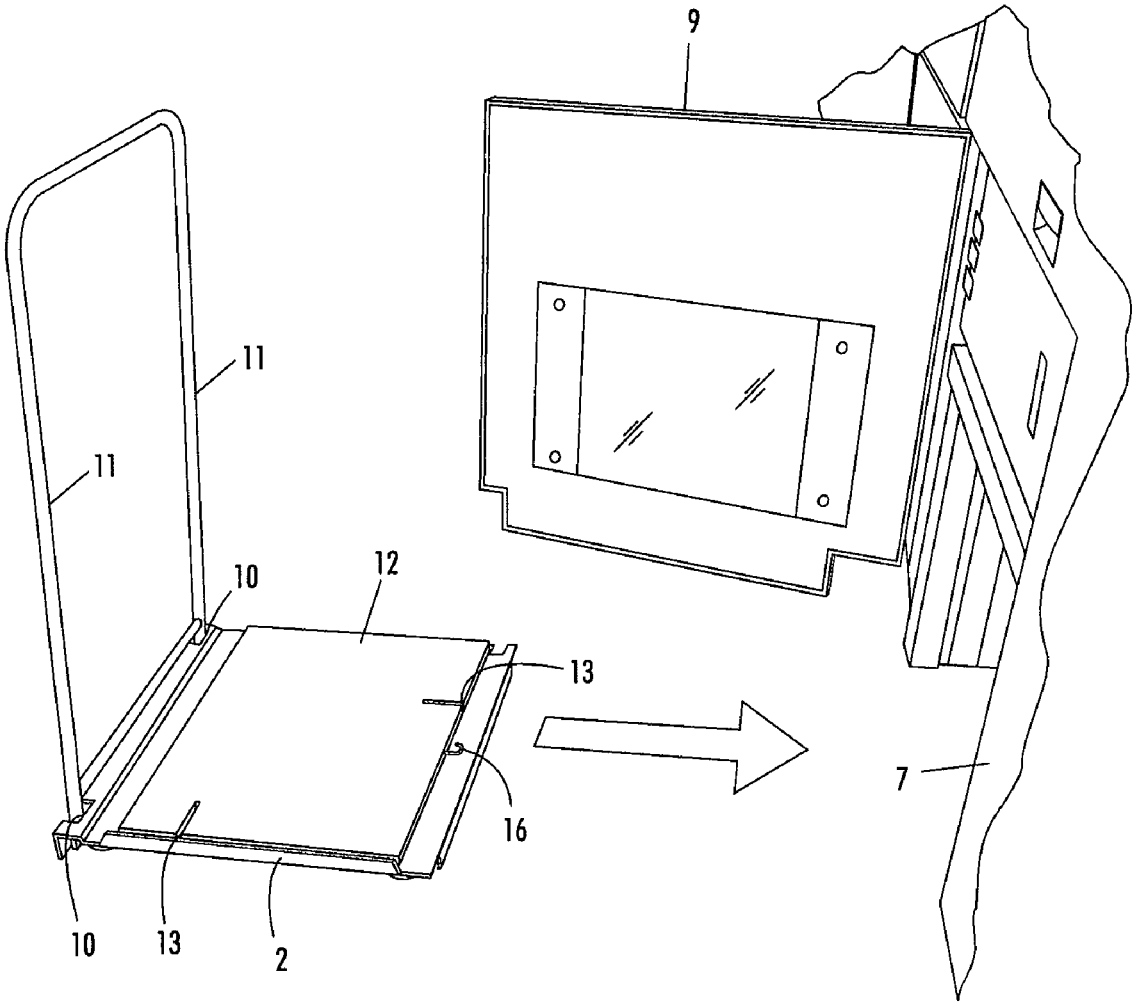
FIG. 4 shows the stacker cart with the sliding plate upper surface when it is removed from finisher module of the marking machine without a paper stack.
Figure 9:
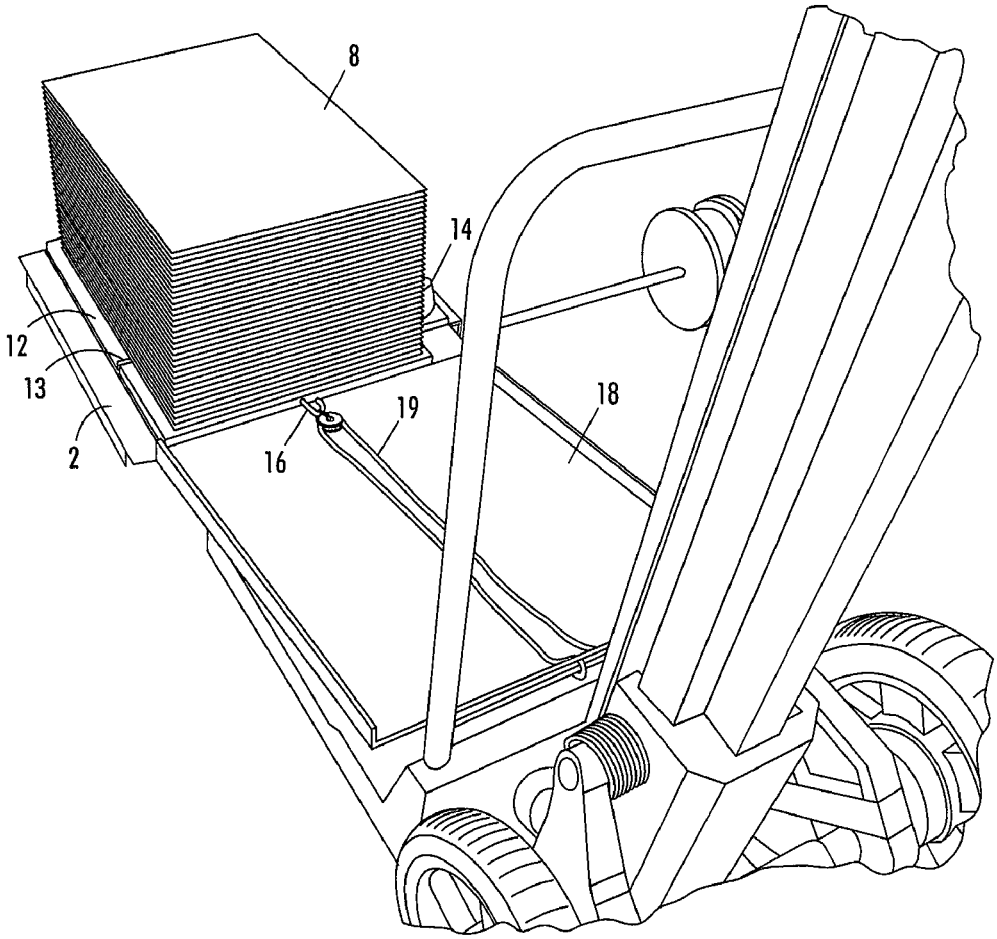
FIG. 9 illustrates the stacker cart as the stacker plate is being removed from the stacker cart to another surface.

In FIG. 4, the stackless stacker cart 2 is shown where the sliding plate 12 has only two slots 13, however, any suitable number of slots 13 may be used. When the paper stack 8 is removed, the emptied stacker cart 2 is pushed back into the finishing module for a second collection of paper. Once stacker cart 2 is reinserted into finisher module 7 (or any other paper collecting structure), handle 11 is removed from apertures 10. The sliding plate 12 has at least one hook 16 on one of its outer side surfaces to accommodate pulling sliding plate 12 off the stacker cart 2 as shown in FIG. 9.

Figure 5:
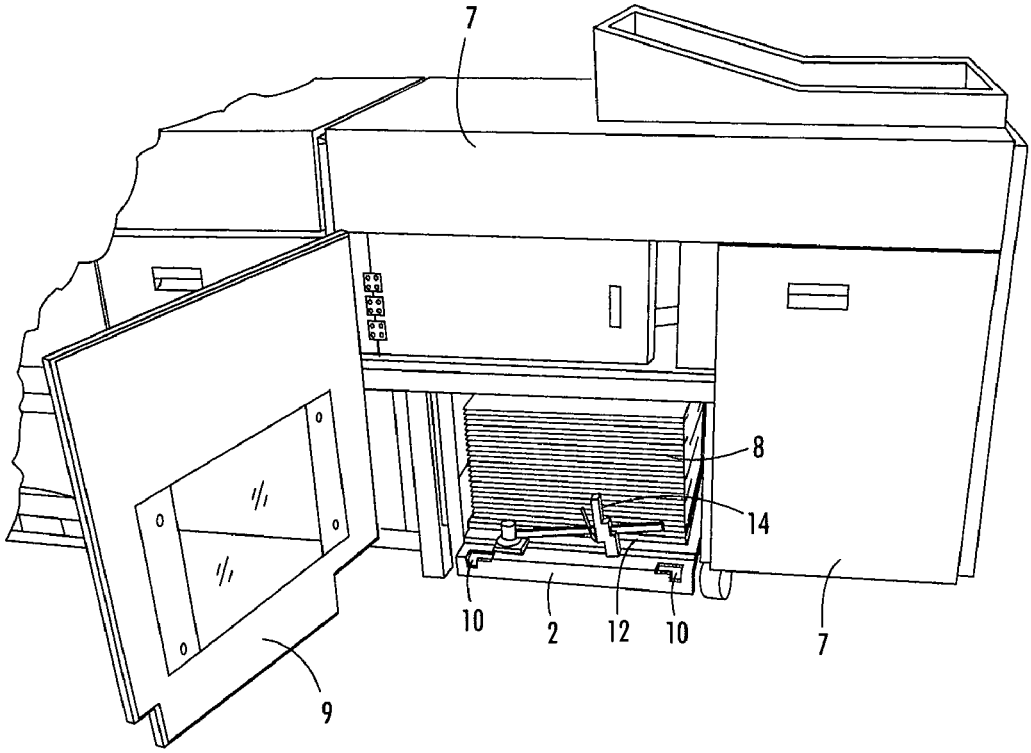
FIG. 5 illustrates the stacker cart when installed in the finisher module with a paper stack and ready to be removed from the finisher module.

In FIG. 5, a stacked stacker cart 2 is shown just prior to removal from finisher module 7. Clamps 14 hold the stack 8 in place while being removed. The paper stack 8 rests on sliding plate 12 until removed to be placed upon another surface by the user. The handle 11 is then reinserted into apertures 10 to remove the stacker cart 2 from the marker-finisher module 7.

Figure 6A:
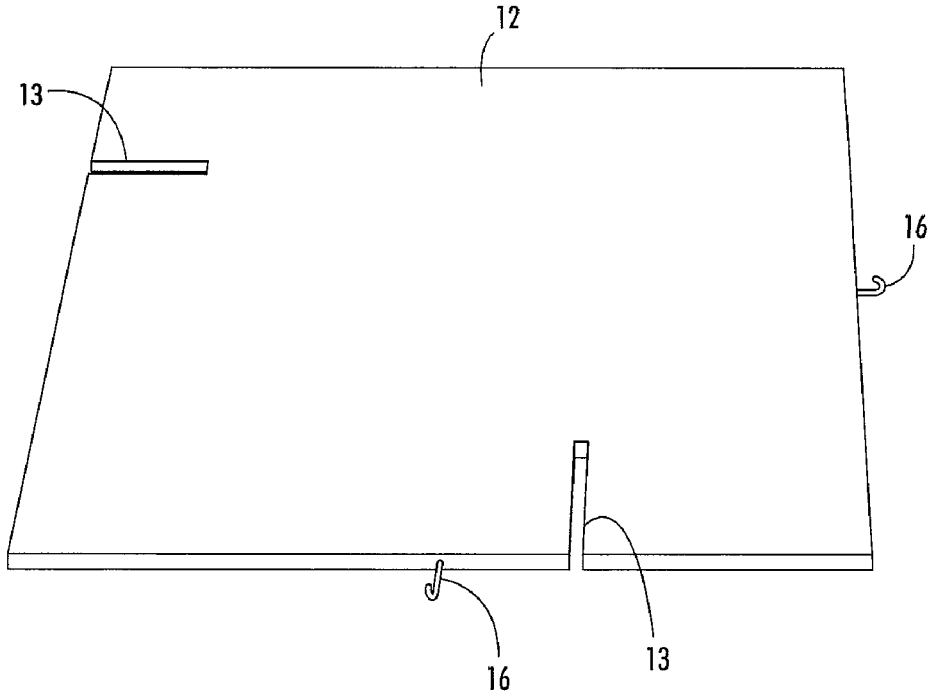
FIG. 6A illustrates the upper surface of the sliding plate of the stacker cart.
Figure 6B:
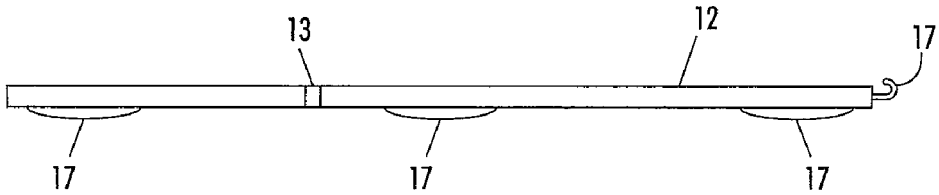
FIG. 6B is a side view of the sliding plate.

In FIG. 6A, the top surface of sliding plate 12 is shown with only two slots 13, however, any suitable number of slots 13 may be used. A hook 16 is shown on at least one side portion of sliding plate 12, however, any number of hooks 16 or other remover means may be used. In FIG. 6B, a side view of sliding plate 12 is shown. In 6B, the sliders 17 extend beyond the lower surface of sliding plate 12. Shown also is hook 16 and slots 13 in a side view.

Figure 7A:
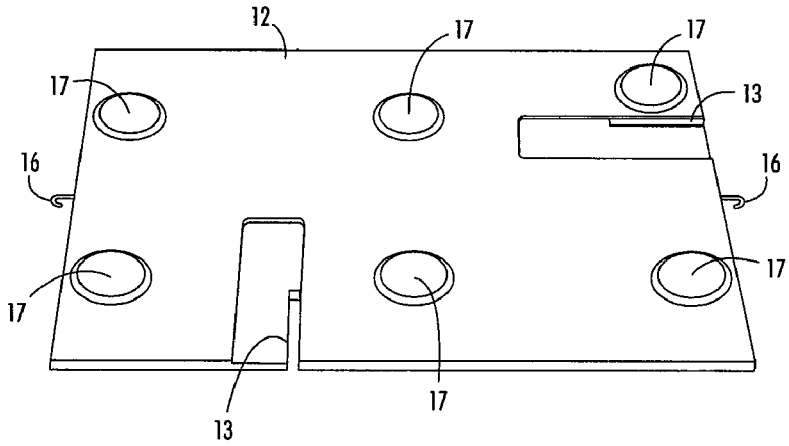
FIGS. 7A-7C illustrate embodiments of the bottom surface of the sliding plate with a different number of sliders.
Figure 7B:
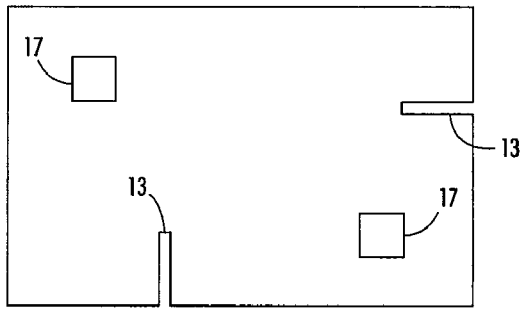
Figure 7C:
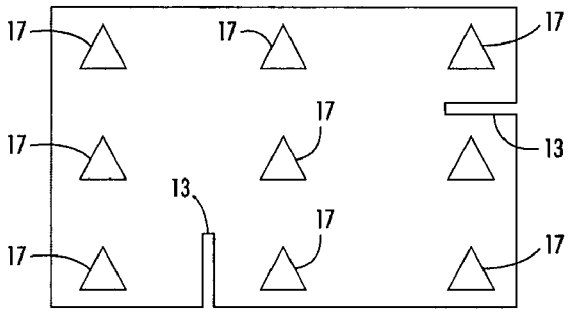

In FIGS. 7A to 7C, the bottom surface of sliding plate 12 is shown having various numbers of sliders 17. The sliders 17 are made from smooth, hard, slidable materials such as Magic Sliders (a trademark of Magic Sliders, L.P.). The sliders 17 can be of any suitable material or configuration such as round (shown in FIG. 7A) square (shown in FIG. 7B) or triangular (shown in FIG. 7C). It is preferred to use round sliders 17 for easier sliding motion. A preferred material for these sliders 17 is a high molecular weight polyethylene, however, any suitably slidable material can be used. A mixture of round, square and triangular sliders may be used, if desirable.

Figure 8:
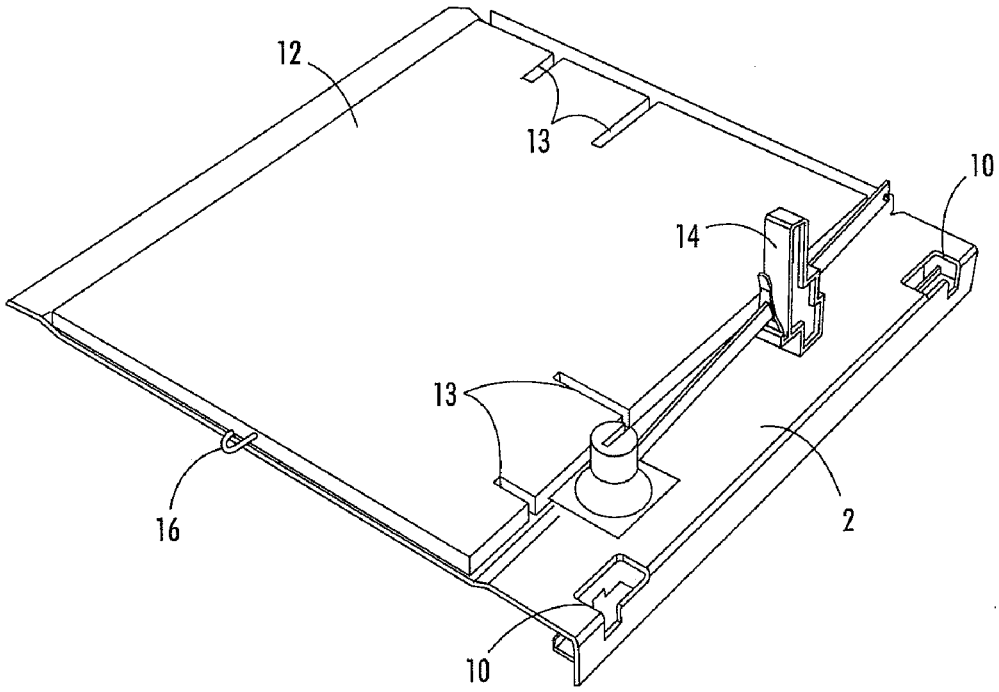
FIG. 8 illustrates the stacker plate of this invention with multiple slots having a clamp in one slot.

In FIG. 8, a top view of stacker cart 2 is shown where the sliding plate 12 has several slot openings 13. Stacker cart 2 is shown to be inserted into finisher 7 prior to stacking paper 8.

FIG. 9 shows the pulling (via hook 16) of the loaded sliding plate 12 from the top surface of stacker cart 2. Once the sliding plate 12 is pulled off stacker cart 2, it can be lifted to another surface by the lifting mechanism of co-pending U.S. application Ser. No. 12/209,287, filed Sep. 12, 2008 or can be transferred to any other surface merely by pulling sliding plate 12 off the stacker cart 2. In the embodiment shown in FIG. 9, a rope 19 is attached to hook 16 and sliding plate 12 pulled into a new surface 18. Sliding plate 12 can be transferred from stacker cart 2 to any desirable surface such as a desk top, a table top, another copier, etc. By "hook" in this disclosure and claims means any suitable remover means to pull plate 12 off said stacker cart 2.

In summary, this invention provides a stacker cart for collecting a paper stack. This stacker cart comprises an upper receiving surface, wheels located at its lower portion for moving the stacker cart and a sliding plate positioned in the upper receiving surface. The sliding plate comprises on its bottom or lower surface a plurality of sliders. The sliding plate comprises slots at its edge portions and at least one hook. This hook is configured to be used when pulling or removing the sliding plate from the stacker cart.

The stacker cart has apertures configured to mate with an elongated inverted U-shaped handle when moving the stacker cart to and from a housing. The sliders in the sliding plate extend vertically beyond the lower surface and are enabled to permit the sliding plate to easily slide off the stacker cart. The slots are used to accommodate various size paper stacks supported on the sliding plate. The sliding plate can comprise from 2-9 separate sliders. The sliding plate has at least two slots on its side portions, at least one hook on its side portions and at least six sliders on its bottom surface.

In another embodiment, this invention provides a stacker cart for collecting a paper stack of papers processed in a finishing station. The stacker cart comprises an upper receiving surface, a bottom surface with wheels adapted to permit easy moving of the stacker cart, apertures located at its side portions to permit connection to a handle for easy moving of the stacker cart into and out of a stacker cart housing and a sliding plate movably located in the earlier-noted upper receiving surface. This sliding plate comprises a plurality of slots enabled to work with clamps to hold and accommodate various size paper stacks. The sliding plate has on its lower surface a plurality of sliders configured to allow the sliding plate to move from the stacker cart to a second receiving surface. The sliding plate comprises at least one hook to be used when pulling the sliding plate from the upper receiving surface of the stacker cart.

The stacker cart of this invention can be used for collecting a paper stack of papers processed in a finishing module or station. This stacker cart comprises an upper receiving surface, a bottom surface with wheels adapted to permit easy moving of the stacker cart, apertures located at its side portions to permit connection to an inverted U-shaped handle for easy moving of the stacker cart into and out of a stacker cart housing and a sliding plate movably located in the upper receiving surface. This sliding plate comprises a plurality of slots enabled to work with clamps to hold and accommodate various size paper stacks.

The sliding plate has on its lower surface a plurality of sliders configured to allow the sliding plate to move from the stacker cart to a second receiving surface. The sliding plate comprises at least one hook to be used when pulling the sliding plate from the upper receiving surface of the stacker cart and having at least two said slots on its side portions and at least six sliders on its bottom surface.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A stacker cart for collecting a paper stack, the stacker cart comprising:

an upper receiving surface with apertures and wheels located at a lower portion of the upper receiving surface for moving the stacker cart, an upwardly extending arm connected to the upper receiving surface, the upwardly extending arm including a distal ends coupled to the upper receiving surface at the apertures; and a sliding plate positioned on the upper receiving surface comprising:

a plurality of sliders located at a lower surface for moving the sliding plate, at least one groove extending in a first direction to receive at least one mechanism that can be adjusted to conform dimensionally to paper received on the sliding plate;

at least one clamp positioned in one of the at least one groove to hold a paper stack in place at the sliding plate when transported away from the upper receiving surface;

at least one groove extending in a second direction to receive at least one mechanism that can be adjusted to conform dimensionally to the paper received on the sliding plate;

at least one hook on an edge portion of the sliding plate configured to be used when pulling or removing the sliding plate from the upper receiving surface to another location.

2. The stacker cart of claim 1 wherein the upwardly extending arm is an elongated U-shaped handle means for moving the stacker cart to and from a housing in a finishing station.

3. The stacker cart of claim 2 wherein the at least one groove extending in a first direction and the at least one groove extending in a second direction are used to accommodate various size paper stacks.

4. The stacker cart of claim 3 wherein the sliding plate comprises at least two of the sliders.

5. The stacker cart of claim 3 wherein the sliding plate comprises from 2-9 of the sliders.

6. The stacker cart of claim 3 wherein the sliding plate comprises at least six of the sliders on the lower surface.

7. A stacker cart for collecting a paper stack of papers processed in a finishing station, the stacker cart comprising:

an upper receiving surface having apertures located at side portions to permit moving of the stacker cart into and out of a housing in the finishing station;

an upwardly extending arm connected to the upper receiving surface, the upwardly extending arm including a distal ends coupled to the upper receiving surface at the apertures;

a transfer plate movably located on the upper receiving surface having a plurality of slots enabled to hold and accommodate various size paper stacks;

at least one clamp positioned in one of the plurality of slots to hold a paper stack in place at the transfer plate when transported away from the upper receiving surface;

a plurality of movables configured to allow the transfer plate to move from the upper receiving surface to a second receiving surface; and at least one hook to be used when pulling the transfer plate from the upper receiving surface of the stacker cart;

wherein the movables on the transfer plate are selected from the group consisting of wheels, slides, and bearings.

8. The stacker cart of claim 7 wherein the upwardly extending arm is an elongated U-shaped handle means for moving the stacker cart to and from a housing in a finishing station.

9. The stacker cart of claim 8 wherein movement of the upper receiving surface is achieved by selecting a group of wheels, slides, bearings and mixtures thereof.

10. The stacker cart of claim 9 wherein the transfer plate comprises at least two of the movables.

11. The stacker cart of claim 9 wherein the transfer plate comprises from 2-9 of the movables.

12. The stacker cart of claim 9 wherein the transfer plate comprises at least six of the movables on the lower surface.

13. A stacker cart for collecting a paper stack of papers processed in a finishing station, the stacker cart comprising:

an upper receiving surface, a bottom surface with wheels adapted to permit easy moving of the stacker cart, apertures located at its side portions to permit connection to an elongated U-shaped handle means for moving of the stacker cart into and out of a stacker cart housing in the finishing station, and a sliding plate movably located in the upper receiving surface, the sliding plate comprising a plurality of slots enabled to work with clamps to hold and accommodate various size paper stacks, at least one clamp positioned in one of the plurality of slots to hold a paper stack in place at the sliding plate when transported away from the upper receiving surface;

the sliding plate having on its lower surface a plurality of sliders configured to allow the sliding plate to move from the stacker cart to a second receiving surface independently of the stacker cart, the sliding plate comprising at least one hook to be used when pulling the sliding plate from the upper receiving surface of the stacker cart, and having at least two the slots on its side portions, at least one hook on its side portions, and at least four sliders on its bottom surface.

14. The stacker cart of claim 13 wherein the sliding plate comprises from 4-9 sliders on its bottom surface.

15. The stacker cart of claim 13 wherein the sliders at the sliding plate are selected from the group consisting of round sliders, square sliders, triangular sliders and mixtures thereof.

* * * * *